United States Patent [19]

Bendel

[11] Patent Number: 4,960,237

[45] Date of Patent: Oct. 2, 1990

[54] SELF-CONTAINED INSERT MAILER

[76] Inventor: Bruce Bendel, 1545 White Oak Rd., Lake Forest, Ill. 60045

[21] Appl. No.: 229,989

[22] Filed: Aug. 9, 1988

[51] Int. Cl.[5] ..... B65D 27/06; B65D 27/10; B65D 27/34

[52] U.S. Cl. ..... 229/73; 229/69; 282/11.5 R; 206/610

[58] Field of Search ..... 229/73, 69; 282/11.5 A, 282/11.5 R; 206/610

[56] References Cited

U.S. PATENT DOCUMENTS

| | | | |
|---|---|---|---|
| 3,104,799 | 9/1963 | Steidinger | 229/69 |
| 3,411,699 | 11/1968 | Pine et al. | 229/73 |
| 3,419,286 | 12/1968 | Noonan et al. | 229/69 |
| 3,507,519 | 4/1970 | McNabb | 229/73 |
| 3,777,971 | 12/1973 | Steidinger | 524/5 |
| 3,837,565 | 9/1974 | Johnsen | 206/610 |
| 4,081,127 | 3/1978 | Steidinger | 229/73 |
| 4,095,695 | 6/1978 | Steidinger | 229/69 |
| 4,102,489 | 7/1978 | Lucas | 229/73 |
| 4,157,759 | 6/1979 | Dicker | 229/73 |
| 4,305,506 | 12/1981 | Greenwald | 229/73 |
| 4,308,987 | 1/1982 | Solomon | 229/73 |
| 4,332,346 | 6/1982 | Kronman | 229/73 |
| 4,334,618 | 6/1982 | Buescher | 229/73 |
| 4,335,845 | 6/1982 | Dierks et al. | 229/73 |
| 4,354,631 | 10/1982 | Stevenson | 229/73 |
| 4,380,315 | 4/1983 | Steidinger | 206/610 |
| 4,382,539 | 5/1983 | Kronman | 229/73 |
| 4,418,865 | 12/1983 | Bowen | 229/69 |
| 4,437,852 | 3/1984 | Volk et al. | 229/73 |
| 4,440,341 | 3/1984 | Pennock | 229/73 |
| 4,445,635 | 5/1984 | Barr | 229/73 |
| 4,492,334 | 1/1985 | Dicker | 229/69 |
| 4,524,903 | 6/1985 | Vath | 229/73 |
| 4,625,909 | 12/1986 | Ferrando | 282/11.5 A |
| 4,632,427 | 12/1986 | Angus | 229/73 |
| 4,669,652 | 6/1987 | Seguin | 229/73 |
| 4,770,337 | 9/1988 | Leibe | 229/73 |

FOREIGN PATENT DOCUMENTS

| | | | |
|---|---|---|---|
| 0001180 | 3/1979 | European Pat. Off. | 229/73 |
| 2383842 | 11/1978 | France | 229/73 |

OTHER PUBLICATIONS

Illinois Secretary of State Mailer (no date available).
Pioneer Press Mailer (no date available).
Daily Record Mailer (no date available).
The News-Sun Mailer (no date available).
Taylor & Associates ("Infoseal") (no date available).
American Express Mailer (no date available).
General Business Forms ("Zip-Pak") Mailer (no date available).

*Primary Examiner*—Stephen Marcus
*Assistant Examiner*—Jes F. Pascua
*Attorney, Agent, or Firm*—Lockwood, Alex, FitzGibbon & Cummings

[57] ABSTRACT

A self-contained insert mailer includes a plurality of similarly sized and interconnected individual plies which are arranged in overlying relationship to form an outgoing individual mailer containing an outgoing envelope, one or more insert message plies and a return envelope. The mailer is folded along one or more outgoing envelope fold lines so that the front ply adhesively engages the back ply to define an outgoing envelope containing the insert message plies therebetween. When the mailer is folded along the outgoing envelope fold lines, each of the outgoing envelope and the return envelope have a height to length ratio which is between 1:1.3 and 1:2.5.

34 Claims, 3 Drawing Sheets

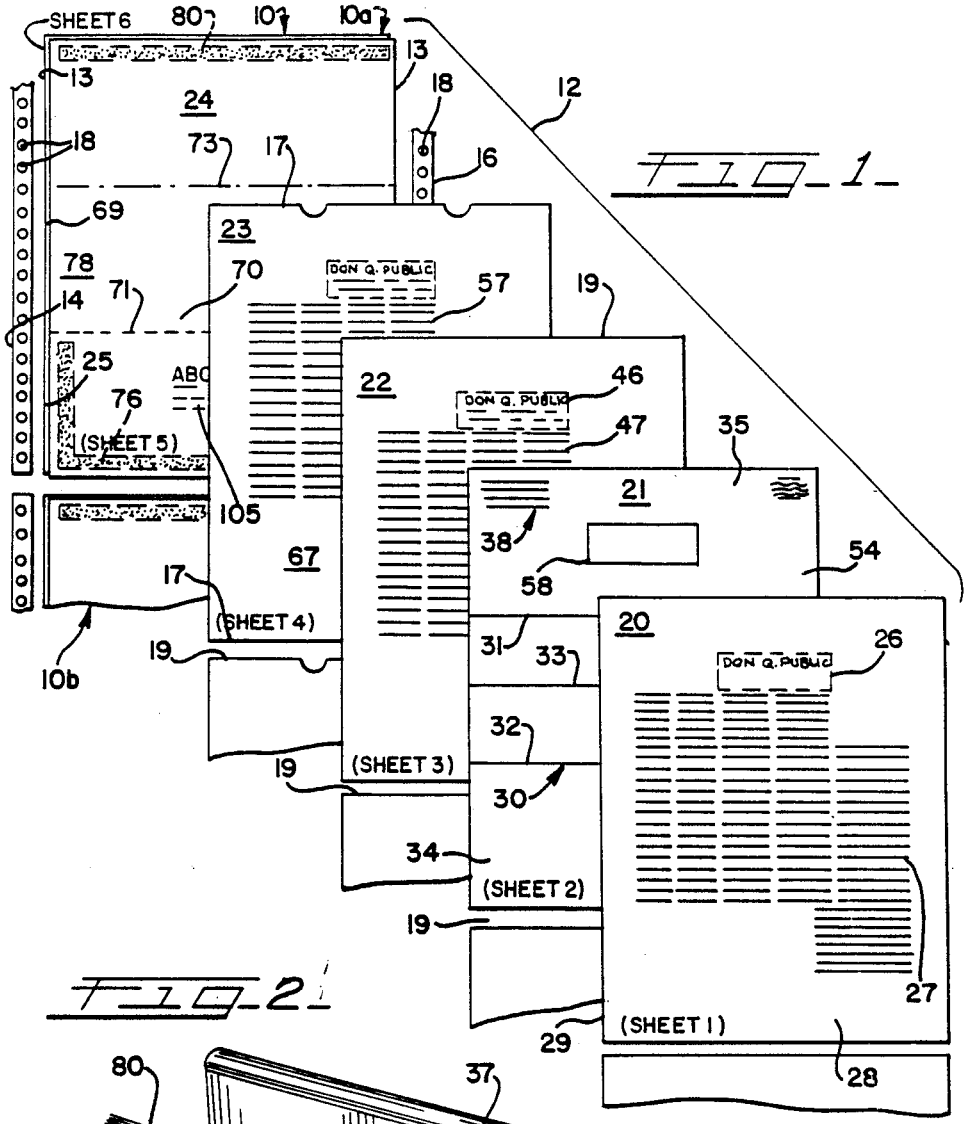
FIG. 1
FIG. 2
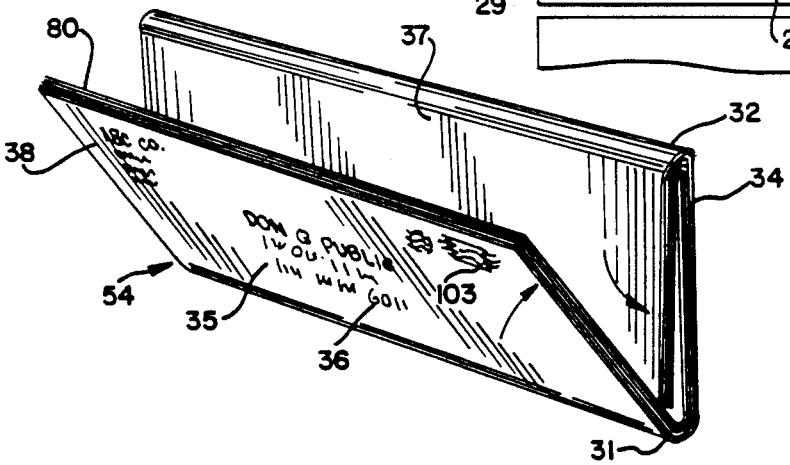

FIG-6 LETTER-SIZE MAIL DIMENSIONAL STANDARDS

SELF-CONTAINED INSERT MAILER

BACKGROUND AND SUMMARY OF THE INVENTION

The present invention relates generally to an improved insert mailer and, more particularly, to a self-contained insert mailer assembly having a return envelope and insert message sheets incorporated therein.

Various types of mailers are widely used by billing authorities for mailing billing information to customers. To speed the billing process, multi-part billing mailers have been developed which typically contain a billing statement or statements and a preaddressed return envelope inserted within the outgoing mailer envelope.

The U.S. Postal Service issued new postal regulations in 1978, which defined the dimensions of "standard size" first class letter-size mail. These regulations further imposed an additional postage surcharge on "non-standard" sizes, i.e. those pieces which exceeded the regulations' dimensional guidelines. For first class weighing 1 ounce or less, a mail piece was considered "standard" if (1) it had a minimum dimension of 3½ inches high by 5 inches long, or (2) it had a maximum dimension of 6⅛ inches high by 11½ inches long, or (3) it exceeded the minimum dimensions and fell under the maximum dimensions, but had a height to length ratio of greater than or equal to 1 to 1.3 and less than or equal to 1 to 2.5. Any envelopes which satisfied this criteria required only normal first class postage; other sizes required additional postage for first class mailing. In order to avoid this postal surcharge, the maximum size envelope and accompanying insert plies which can be used in insert mailers are limited to less than or equal to 6⅛ inches high by 11½ inches long. As such, the amount of billing information in such mailers is restricted to that which can fit on such sized billing inserts. In order to accommodate customers with large amounts of billing which extend more than 6 inches deep on an insert, billing authorities are faced with three mailing choices First, the billing authority can use a smaller size typeface on an automated printer and increase the number of lines per inch of billing information on its insert This typically requires that the printer be reprogrammed to accommodate the new typeface and spacing, which is costly and may not ensure that all the billing information will fit on one billing insert. Secondly, the billing authority can mail out a large envelope with large billing insert plies and pay the additional postage, which increases the cost of billing. Thirdly, the billing authority can send multiple outgoing bills to the customer, which avoids the postal surcharge but effectively multiplies the cost of billing. Therefore a need exists for an insert mailer having insert plies larger than 6 inches high which can accommodate large amounts of billing, and which falls within the Postal Service standard size guidelines.

In addition, the use of optical character readers for processing mail by the U.S. Postal Service is growing. These readers scan the face of mail envelopes to read bar codes (which typically indicate that the mail piece is business reply mail) as well as addresses. The Postal Service has issued specifications for the location of these bar codes and addresses so that the bar codes and addresses of mail pieces fall within the scanning area of the optical character readers.

A typical mailer construction is disclosed in U.S. Pat. No. 4,418,865, wherein a multi-ply continuous mailer is assembled by aligning a plurality of plies and adhesively securing the front and back plies together to define an outgoing envelope which contains one or more insert message or billing plies. The outgoing envelope, after being opened, is then assembled by the customer to form a return envelope for returning the bill payment The customer opens the outgoing envelope by removing a tear strip disposed along the top ply to free the insert message plies from the outgoing envelope The portion of the back ply which remains is folded over the front face of the outgoing envelope to form a return envelope and to conceal the original address.

This mailer construction suffers from several shortcomings. First of all, the insert plies must be sized to lie within the borders of the outgoing envelope. Therefore, the maximum size of the inserts is limited not only by the size of the outgoing envelope, which is typically 6 inches high by 11 to 11½ inches long, but also by the width of the marginal edge glue strips which hold the outgoing envelope together. These envelope glue strips encroach upon the width of the billing insert and reduce the available billing information area thereon Moreover, the tear strip which frees the insert message plies and return envelope from the outgoing envelope also encroaches upon the size of the insert. These restrictions on the size of the insert plies, result in an average loss of 1 to 2 inches of vertical billing space on the insert message plies.

Secondly, in this type of mailer, the billing inserts are contained within a preformed return envelope and therefore must be inserted or stuffed into the outgoing envelope formed by the front and back plies. This insertion step is labor-intensive and is costly.

The self-contained insert mailer of the present invention overcomes the aforementioned shortcomings. A self-contained insert mailer incorporating the principles of the present invention, can accommodate a plurality of billing insert and outgoing and return envelope plies as large as 12 to 18 inches high by 11 to 11½ inches long When folded along appropriate outgoing envelope fold lines, the final dimensions of the insert mailer of the present invention fall within the Postal Service height to length ratio of greater than or equal to 1 to 1.3 and less than or equal to 1 to 2.5, thereby accommodating larger amounts of billing information and avoiding the first-class surcharge for non-standard sizes. In addition, the addresses on the mailer outgoing envelope and mailer return envelope are easily positioned within the prescribed area for optical character reading by Postal Service processing equipment and thus, no reprogramming of the billing print format is necessary.

In one principal aspect of the present invention, a self-contained insert mailer includes a plurality of individual, adjacently overlying plies which are interconnected together to form an insert mailer assembly The front ply of the mailer assembly defines an outgoing billing envelope, and includes one or more insert plies disposed adjacently beneath it, and further includes a back ply disposed adjacently beneath the insert plies, which back ply defines a mailer return envelope. The insert mailer is folded upon itself along appropriately placed first and/or second fold lines and the front ply adhesively engages the back ply to form an outgoing envelope which has a height to length ratio which falls between 1 to 1.3 and 1 to 2.5.

In another principal aspect of the present invention, the insert mailer assembly includes a second back ply disposed adjacently beneath the back ply and is adhesively secured to the back ply to define a return envelope having an envelope pocket therebetween. Similar to the outgoing envelope, the return envelope also has a height to length ratio which falls between 1 to 1.3. and 1 to 2.5.

In still another principal aspect of the present invention, the insert mailer assembly back ply includes adhesive means peripherally disposed thereon and a return envelope fold line separating the back ply into a return envelope face portion and a return envelope back portion, such that the back ply defines a return envelope having an insert pocket therein when folded upon itself along the return envelope fold lines.

In yet another principal aspect of the present invention, the front ply and the one or more insert plies of the mailer assembly include an image transfer coating on the rear faces thereof so that the billing information can be printed onto a mailer by an impact printer after assembly rather than prior to assembly. The billing information is transferred to the underlying plies. This allows the billing authority to print its own mailers, and eliminates the need for billing printing to be done offsite at the mailer assembly plant.

These and other objects, features and advantages of the present invention will be clearly understood through a consideration of the following detailed description.

BRIEF DESCRIPTION OF THE DRAWINGS

In the course of this description, reference will be made to the attached drawings, in which:

FIG. 1 is an exploded view of one embodiment of a self-contained insert mailer constructed in accordance with the principles of the present invention;

FIG. 2 is a view of the insert mailer of FIG. 1 showing how the mailer is folded along first and second outgoing envelope fold lines to form the mailer outgoing envelope;

FIG. 6 shows a template illustrating the U.S. Postal Service dimensional guidelines for "standard" letter-size mail;

DETAILED DESCRIPTION OF THE PREFERRED EMBODIMENTS

Figure 3:
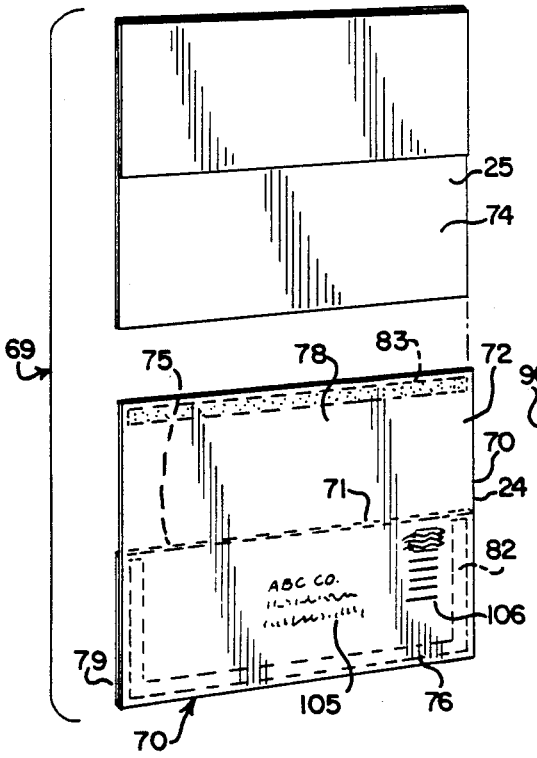
FIG. 3 is a view of the first and second back plies of the mailer of FIG. 1 showing the return envelope discard portion being detached from the return envelope portion.

Referring to FIG. 1, a first embodiment of a self-contained insert mailer 10 constructed in accordance with the principles of the present invention is shown as having a plurality of individual sheets or plies 12. The plies 12 are disposed in adjacent overlying relationship, and may be interconnected by conventional sealing means, such as heat-activated adhesive deposited along one or more of the plies' transverse edges 17 or along the marginal edges 13 of the plies 12 to form a single mailer 10. Each ply 12 has removable feed strips 14, 16 disposed along opposite marginal edges 13 of individual mailer units which may be provided with control holes 18 to engage pins on various printer and assembler feed rolls (not shown) used in assembling and bursting the mailers. As shown, the transverse edges 17 of the plies are typically provided with lines of weakening 19, such as spaced perforations, which extend transversely between the removable feed strips 14, 16 to aid in separating or bursting a single mailer 10*a* from an adjacent mailer 10*b*.

The individual mailer 10 includes an outgoing envelope 54, a series of billing inserts 22, 23 and a two-piece return envelope 70. This mailer embodiment includes six individual plies 20, 21, 22, 23, 24 and 25 of generally equal size. The lines of weakening 19 extend transversely between the feed strips 14, 16 and divide a continuous sheet of plies into a series of detachably interconnected individual multiple ply mailers 10. A removable first ply 20 or flysheet is disposed on top of the individual mailer adjacently overlying the plurality of plies 21-24 and in detachable engagement therewith. Flysheet 20 may contain preprinted customer address information 26 and billing information 27 on its front face 28 to serve as a billing record for the billing authority. The flysheet 20 is typically detached or decollated from individual mailers after exiting from an impact printer. The flysheet 20 typically contains conventional image transfer means on its rear face 29 in the designated billing and address information areas 26; 27, such as either a spot carbon coating or a carbonless transfer medium, to transfer the printed address and billing information onto one or more of the underlying mailer plies.

The second or mailer front ply 21 is disposed adjacently beneath the flysheet 20 overlying the remaining plies 22–25, and is generally aligned therewith along its marginal and transverse edges. Front ply 21 serves as an outgoing envelope ply which defines the outgoing envelope 54 of the mailer 10 which contains billing inserts 22, 23 and a return envelope 70. The front ply 21 may also contain an image transfer means such as that described above on its rear face so that the billing information 27 printed on the flysheet 20 will transfer through to the first and second insert plies 22 and 23.

The front ply 21 includes an outgoing envelope face portion 35 which contains the customer address information 36 and a return address 38, an outgoing envelope back portion 34 and an outgoing envelope intermediate portion 37 that is held between the face and back portions 35, 34 when the mailer is folded. These three outgoing envelope portions are separated by outgoing envelope fold lines 30, shown as first fold line 31 and second fold line 32 in FIG. 1, which are generally spaced apart so as to generally divide the outgoing envelope ply 21 into three portions of substantially equal height.

The customer address 36 may be either printed by an impact printer directly on the outgoing envelope ply face portion 35 (FIG. 2), or it may be printed directly on the flysheet 20 as described above or it may yet be printed on the first message insert ply 22. In the latter case the front ply 21 will have a conventional address window 58 die cut therein to allow the first insert customer address 46 to show through. (FIG. 1.) In this embodiment, the outgoing envelope 54 is initially formed when the mailer 10 is folded along the first and second fold lines 31 and 32, and is completed when an adhesive strip 80 utilizing a conventional adhesive located on the rear of the second back ply 25 is adhered to the outgoing envelope intermediate portion of front ply 20. (FIG. 2.). When assembled, the customer address 36 is positioned in the area of the outgoing envelope specified by the Postal Service for automated, optical character reading processing.

Figure 4:
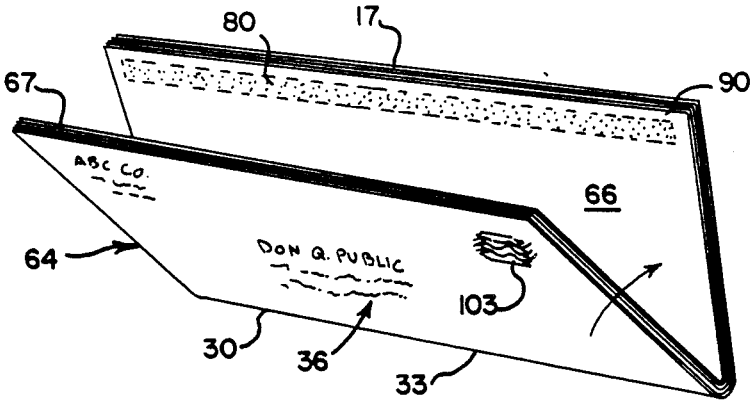
FIG. 4 is a view of the insert mailer of FIG. 1 showing how the mailer is folded along a first outgoing envelope fold line to form the mailer outgoing envelope.

Alternately, as shown in FIG. 4, the mailer 10 can be folded upon itself once along a single fold line 33, which is spaced between the top and bottom transverse edges 17, so as to generally divide the front ply 21 and the ensuing outgoing envelope 64 into two equal portions of substantially the same height. Similar to the first embodiment, when the mailer shown in FIG. 4 is folded into an outgoing envelope, the customer address is positioned in the area specified by the Postal Service for optical character reading thereof. In this one-fold configuration, the outgoing envelope 64 is completed in a similar manner as the outgoing envelope 54 shown in FIG. 2, that is, by adhering the adhesive strip 80 on the rear of the back ply 66 to the opposing face 67 of the mailer back ply 25.

The third and fourth plies 22, 23 are the billing insert plies which contain the customer billing information 47, 57 and are disposed adjacently beneath the front ply 21 in generally alignment therewith. As described above, since the outgoing envelopes 54,64 are assembled by adhering outgoing envelope portions together rather than relying on a glue strip at both transverse edges, virtually the entire height of the insert plies 22 and 23 is available for billing information. Each insert ply 22, 23, preferably includes an image transfer means on their rear faces to accommodate the printing of the billing information. The pressure of the impact printer transfers the address and billing information from the image transfer means to the various insert message plies. Therefore, the insert mailer of the present invention can be printed by the billing authority after the mailer has been assembled. Thus the billing authority may print the mailers itself, rather than sending mailers offsite to be printed at the assembly plant, prior to assembly of individual mailers.

The remaining fifth and sixth plies 24, 25 are disposed adjacently beneath the insert plies 22, 23 in general alignment with the mailer overlying plies 12. Importantly, the fifth ply 24 serves as a mailer first back ply and the sixth ply 25 serves as a mailer second back ply which are adhesively secured together to define a two-ply return envelope mailer ply 69. The return envelope mailer ply 69 includes a lower, return envelope portion 72 as best seen in FIG. 3 and an upper, detachable discard portion 74 separated by transverse lines of weakening 73 as seen in FIG. 1. Preferably, the transverse lines of weakening 73 of two-ply return envelope 70 are spaced apart from the back ply transverse edges 17 such that the return envelope 70 has dimensions which fall within the Postal Service restrictions discussed in detail below.

The first back ply 24 is secured to the second back ply 25 by a conventional adhesive 82 generally peripherally disposed between the two plies, shown as a U-shaped pattern in FIGS. 1 and 3, to define a return envelope pocket 75 therebetween. The return envelope 70 includes a return envelope face portion 76 having a business reply address 105 and a business reply indicator bar code 106, a return envelope flap or back portion 78 and a return envelope intermediate portion 79. The business reply address 105 and bar code indicator 106 are positioned within the return envelope face portion 76 so as to be easily read by Postal Service optical character reader processing equipment. The face portion 76 is separated from the flap portion 78 by a transverse fold line 71. The flap portion 78 is secured to the intermediate portion 78 by the customer by means of a conventional adhesive strip 83 disposed on either the flap portion 78 or intermediate portion 79.

Figure 5:
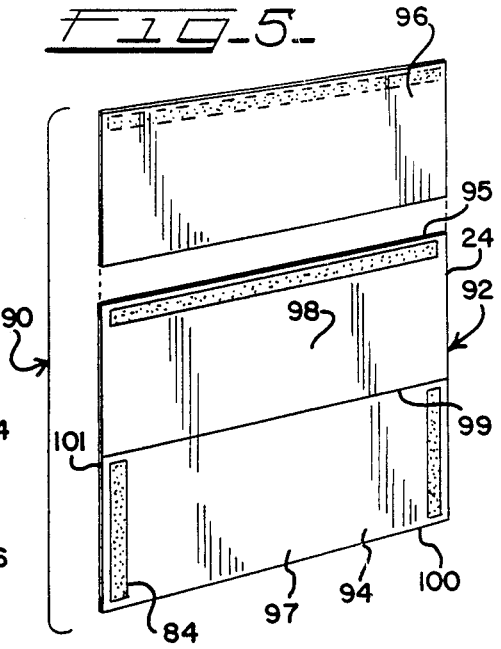
FIG. 5 is a view of a single back ply used with a second embodiment of the present invention, showing the return envelope discard portion being detached from the return envelope portion.

A second embodiment of a mailer is constructed according to the principles of the present invention by using a mailer single back ply 90, shown in FIG. 5, in place of the mailer first and second back plies 24, 25 of the first embodiment to form a one-ply return envelope 92. In this embodiment, the back ply 90 is disposed adjacently beneath the previously described insert plies 22 and 23 and in general alignment therewith.

The back or return envelope ply 90 includes a lower return envelope portion 94 and an upper detachable, discard portion 96 which are separated from each other by a transverse line of weakening 95, such as perforations, to allow the customer to separate the two return envelope portions easily. The lower return envelope portion 94 includes face portion 97 and a back or flap portion 98 which are separated by a transverse fold line 99. As shown in FIG. 4, adhesive strips 84 are generally peripherally disposed on the front face 100 of the lower return envelope portion 94, which allow the customer to form the return envelope 92 by adhering these adhesive strips 84 to their opposing return envelope portions 97, 98 so as to define a return envelope pocket therebetween. The adhesive strips 84 can also be disposed on the rear face 101 of the return envelope portion.

Similar to the adhesive 83 used on the two-ply return envelope 70, the one-ply return envelope adhesive strips 84 may be of any conventional adhesive such as the type which must be moistened to activate it, a pressure sensitive adhesive covered by a release paper or a combination thereof. The one-ply return envelope 90 is easily assembled by folding the flap portion 94 along the return envelope transverse fold line 99, and adhering the flap portion 98 to the face portion 97.

In this embodiment, the line of weakening 95 is spaced apart from the back ply top and bottom transverse edges 17 such that the one-ply return envelope 90 falls within the dimensional restrictions discussed below. Alternatively, when the one-ply return envelope 90 embodiment is used where the mailer dimensions are such that only one fold is required to form the outgoing and return envelopes (FIG. 4), there may be no need for any transverse lines of weakening 95 on the return envelope 92.

Mailers of the present invention need not include the single or two-ply return envelopes described above. Rather, the mailers may only include the front ply 21 and the one or two insert plies 22 and 23, in instances when the billing authority chooses not to send return envelopes with the outgoing envelopes. In this instance, all of the feature of the front and insert plies described above are still utilized, such as the outgoing envelope fold lines 30.

In an important aspect of the present invention, because all of the individual plies are generally equal in size, the mailers can accommodate billing insert plies which have heights as large as 12 to 18 inches and yet be classified as Postal Service "standard" size first class mail after they are folded into the outgoing envelope.

This advantage allows the billing authority to print approximately twice the billing information found on a typical mailer having a height of 6⅛ inches.

Figures 6A, 6B, 6C:
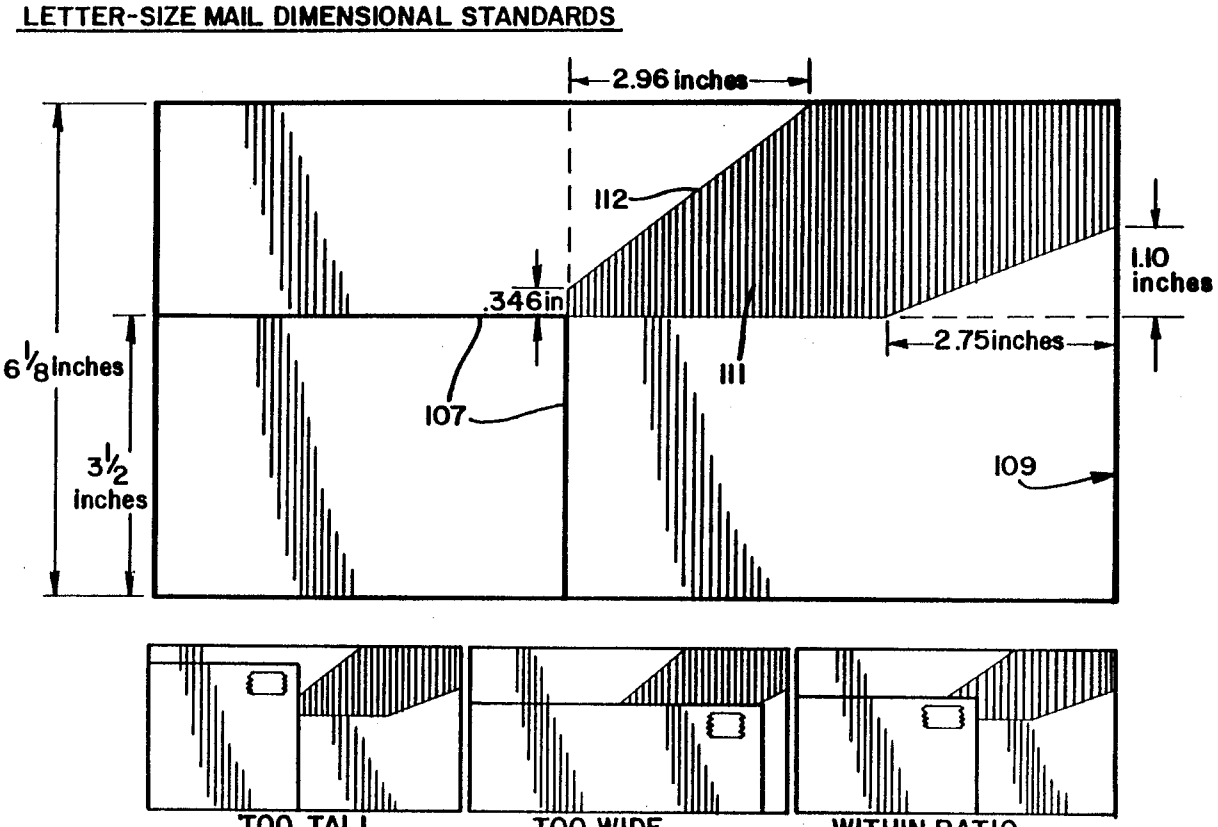
FIG. 6A shows a non-standard envelope which is too tall to be considered standard.
FIG. 6B shows a non-standard envelope which is too wide to be considered standard.
FIG. 6C shows a standard envelope which falls within the "standard" height to length ratio.

FIG. 6 illustrates the dimensional restrictions imposed upon letter-size first class mail by the 1978 U.S. Postal Service Regulations. FIG. 6 shows the minimum and maximum sizes for first-class letters and the height to length ratios of "standard" letter-size mail pieces. At its lower left, FIG. 6 includes a minimum size mail piece grid 107 which is 3½ inches high by 5 inches long. Any mail piece which does not completely fill the grid 107 or extend past both of the upper right grid lines of grid 107 is unmailable. The outer grid 109 of FIG. 6 defines the maximum dimensions for "standard" mail pieces which will avoid the first class postal surcharge. These dimensions are 6⅛ inches high by 11½ inches long. Mail pieces which are larger than the minimum grid 107 and smaller than the maximum grid 109 must have a minimum height to length ratio of 1 to 1.3 and a maximum ratio of 1 to 2.5. The upper right corner of the mail piece must touch the shaded area 111 to be considered "standard" as shown in FIG. 6C. Mail piece sizes whose upper right corners fall outside the shaded area 111, as shown in FIGS. 6A–6B, are considered non-standard and are subject to an additional first class postal surcharge. In the shaded area 111, the left border 112 represents the minimum height to length ratio of 1 to 1.3 while the right border 113 represents the maximum height to length ratio of 1 to 2.5.

Both of the outgoing envelope and return envelope of mailers of the present invention, when folded along the appropriate envelope fold lines, fall within the above height to length ratios. As described above, the mailers can be either folded once along a first fold line 33 or twice along the first and second fold lines 31, 32 so that the final folded mailer outgoing envelope falls within the Postal Service "standard" classification. The billing authority is presented with a choice between the use of one or two outgoing envelope fold lines to accommodate larger billing insert sizes which fall within the Postal Service restrictions and avoid a postal surcharge.

Table 1 illustrates a variety of examples of final mailer sizes and height to length ratios which can be used to determine the billing insert (and remaining mailer) ply sizes. The minimum and maximum final mailer heights are listed according to ½ inch increments of the final mailer length. Mail pieces having these final dimensions fall within the FIG. 6 shaded area 111 and so are considered as "standard" under Postal Service guidelines.

TABLE 1

| FINAL MAILER DIMENSIONS | | | | |
|---|---|---|---|---|
| H min (in.) | H max (in.) | L (in.) | H min:L | H max:L |
| 3½ | 3¾ | 5½ | 1.57 | 1.46 |
| 3½ | 4½ | 6 | 1.71 | 1.3 |
| 3½ | 5 | 6½ | 1.85 | 1.3 |
| 3½ | 5⅜ | 7 | 2 | 1.3 |
| 3½ | 5¾ | 7½ | 2.14 | 1.3 |
| 3½ | 6⅛ | 8½ | 2.4 | 1.38 |
| 3⅝ | 6⅛ | 9 | 2.48 | 1.46 |
| 3¾ | 6⅛ | 9½ | 2.53 | 1.55 |
| 4 | 6⅛ | 10 | 2.5 | 1.63 |
| 4¼ | 6⅛ | 10½ | 2.47 | 1.71 |
| 4⅜ | 6⅛ | 11 | 2.5 | 1.79 |
| 4⅝ | 6⅛ | 11½ | 2.48 | 1.87 |

H min = minimum height of final folded mailer.
H max = maximum height of final folded mailer.
L = length of final folded mailer.
H min:L = height to length ratio for given length and minimum height.
H max:L = height to length ratio for given length and maximum height.

By using the above table, one can readily determine if the billing insert size and resultant mailer will give a desired height to length ratio. This can be accomplished by dividing the height of the unfolded insert in half where a single fold line 30 will be used or the unfolded insert can be divided in thirds where two fold lines 31, 32 will be used. The resultant height and the insert length can be compared to Table 1 to determine if the height to length ratio is appropriate. Alternately, one can choose a final mailer height and length dimension from Table 1 and either double or triple the final height to determine the unfolded insert and mailer dimensions. Thus, the mailer dimensions will be limited only by the outgoing envelope height to length ratio obtained and the size limitations of the mailer assembly and printing machinery.

For example, if the mailer plies 12 shown in FIGS. 1 and 2 are 12 inches high by 8½ inches long, the outgoing envelope fold lines 31, 32 will be spaced at equal 4 inch distances from the transverse edges 17, and the outgoing envelope, when folded, will have final dimensions of 4 inches high by 8½ inches long or a height to length ratio of 1 to approximately 2.1. Similarly, if the mailer plies shown in FIG. 5 are 8½ inches high by 8½ inches long and the single outgoing envelope fold line 33 divides the mailer into two equal portions, the outgoing envelope will have final dimensions of 4¼ inches high by 8½ inches long and a final height to length ratio of 1 to 2.

The present invention is particularly suited for automated assembly and processing. Feeds of continuous webs of the front, outgoing envelope ply 21 and the return envelope first back ply 24 may first be fed into a conventional ink printer for application thereto of the postal permit mark 103, outgoing envelope return address 38, the business reply return envelope mailing address 105 and the business reply mail indicator bar code 106. After exiting from the ink printer, those continuous webs next may be fed into an assembler along with continuous webs of flysheet ply 20, insert plies 22 and 23, and if necessary, the return envelope second back ply 25. In instances where a two-ply return envelope is used, the second back ply 25 may be appropriately scored and adhesively secured to the first back ply 24 prior to entering the ink printer.

The assembler indexes and aligns all the plies together and assembles them into mailers by depositing a conventional adhesive, such as heat activated adhesive, on either or both the top and bottom transverse edges 17 of individual mailers and may also further be deposited along the marginal edges 13 of the mailers, if necessary. Since no reduced size insert plies are used, it is possible to use virtually all of the insert plies available space for billing information, and therefore billing information may be printed as near the top and bottom of the insert plies as is possible.

At this point, the continuous feed of individual mailers may be inserted into an impact printer which prints the customer address and the customer bill onto the fly sheet of each mailer or the assembled mailers may be sent to the customer for printing. The address and billing information will be then transferred to the underlying plies by the image transfer means. The continuous feed of mailers are also scored along the transverse lines of weakening 19 and then burst or separated into individual mailers. Depending on the size format, the mailers are then folded once or twice upon themselves along the appropriate fold lines 30 and adhered together with adhesive strip 80 and mailed.

Although the embodiments discussed in the specification have described mailers of the present invention as having one or two insert plies, 22 and 23, it will be understood that the present invention encompasses mailers which use more than two inserts. Additionally, it will be understood that the embodiments discussed may be modified by those skilled in the art to conform to any changes in Postal Service first class mail size regulations without departing from the principles of the present invention.

Finally, it will be understood that the embodiments of the present invention which have been described are merely illustrative of a few applications of the principles of the invention. Numerous modifications may be made by those skilled in the art without departing from the true spirit and scope of the invention.

What I claim is:

1. A self-contained insert mailer for mailing an insert, comprising a plurality of individual, separate plies adjacently disposed in overlying relationship, each of said individual plies being of substantially the same size, the mailer including a front ply, a back ply and at least one insert ply disposed therebetween, said front ply including at least one fold line, said front ply defining a mailer outgoing envelope when said mailer is folded upon itself along said front ply fold line, adhesive means disposed along a face of said back ply for adhesively securing a portion of said back ply to a portion of said front ply after folding said mailer along said front ply fold line to form the mailer outgoing envelope and for maintaining said outgoing envelope in said folded condition, said back ply including a return envelope portion for forming a return envelope, said back ply further including a discard portion separated from the return envelope portion by a line of weakening, said return envelope portion having a return envelope fold line disposed generally parallel to said front ply fold line, the return envelope fold line separating said return envelope portion into a return envelope face portion and a return envelope flap portion, said mailer outgoing envelope having a predetermined height to length ratio conforming to postal height to length ratio standards.

2. The insert mailer of claim 1, wherein the predetermined height to length ratio of said mailer outgoing envelope is between approximately 1:1.3 to approximately 1:2.5.

3. The insert mailer of claim 1, further including an additional flysheet ply overlying and detachably engaging said front ply, said flysheet ply including detachment means for detaching said flysheet ply from said front ply.

4. The insert mailer of claim 1, further including a second back ply disposed adjacent said back ply, and said back ply and said second back ply having return envelope portions thereon, said return envelope portions being adhesively secured together to define a return envelope having a return envelope pocket therein.

5. The insert mailer of claim 4, wherein said back ply and said second back ply each include a discard portion, said back ply and said second back ply including lines of weakening separating said return envelope portions from the discard portions.

6. The insert mailer of claim 4, wherein said second back ply envelope portion includes a a return envelope fold line disposed parallel to said back ply return envelope fold line separating a return envelope flap portion from a return envelope back portion, said return envelope having a height to length ratio of between approximately 1:1.3 to 1:2.5 when folded along said fold line.

7. The insert mailer of claim 1, wherein said front ply includes a mailer outgoing envelope face portion having a die-cut designated address area thereon.

8. The insert mailer of claim 1, wherein said back ply further includes adhesive means disposed thereon which define a return envelope pocket when said return envelope face portion and flap portion are folded along said back ply fold line.

9. The insert mailer of claim 1, wherein said return envelope fold line separates said return envelope portion into a return envelope face portion and flap portion, said return envelope portion forming a return envelope having a height to length ratio of between approximately 1:1.3 to 1:2.5, when said return envelope portion is folded upon itself.

10. The insert mailer of claim 1, wherein said plurality of individual plies are held in said adjacent overlying relationship by detachment means including a strip disposed along marginal edges of said plies, said mailer further including transverse lines of weakening extending between said ply marginal edges to separate individual mailers.

11. The insert mailer of claim 1, wherein said front ply includes a second fold line spaced apart from said fold line separating said mailer into an outgoing envelope face portion, back portion and intermediate portion, said adhesive means securing said back ply to said outgoing envelope intermediate portion when said mailer is folded upon itself along said first and second fold lines to form an outgoing envelope.

12. The insert mailer of claim 1, wherein said front ply includes a mailer outgoing envelope face portion having a designated address area thereon in a preselected location, said designated address area being located within an area of the mailer outgoing envelope face portion conforming to postal specifications for optical character reading when said mailer is folded upon itself along said front ply fold line.

13. The insert mailer of claim 1, wherein said mailer front ply includes image transfer means on one face thereof for transferring an image printed thereon to said insert ply.

14. The insert mailer of claim 1, further including at least two individual insert plies disposed between said front ply and said back ply, said front ply and at least one of said at least two insert plies including image transfer means for transferring the image of printed material from one mailer ply to another mailer ply.

15. A mailer assembly containing a series of interconnected individual mailers, each individual mailer including at least one message insert and a return envelope, comprising a front mailer sheet, a first back mailer sheet and an insert message mailer sheet disposed therebetween adjacent the front and first back mailer sheets, said front mailer sheet, insert message sheet and first back mailer sheet being secured together in adjacent overlying relationship to define a single insert mailer, said first back mailer sheet including a return envelope portion and a discard portion separated from the return envelope portion by a line of weakening, said front mailer sheet including an outgoing envelope first fold line separating said front mailer sheet into an envelope face portion and outgoing envelope back portion, said front mailer sheet defining an outgoing envelope when folded upon itself along said outgoing envelope first fold line, said mailer further including adhesive means for adhering said outgoing envelope together, said first back mailer sheet return envelope portion having a first back mailer sheet fold line separating said return envelope portion into a return envelope face portion and a return envelope flap portion.

16. The mailer assembly of claim 15, further including a second back mailer sheet disposed adjacent said first back mailer sheet and having a second back mailer sheet return envelope portion, said first and second back mailer sheet return envelope portions being adhesively secured together to define a return envelope having a return envelope pocket there between, said first and second back mailer sheets each including a discard portion detachably engaging said return envelope by means of lines of weakening separating said first and second back mailer sheet return envelope portions from the first and second back mailer sheet discard portions.

17. The mailer assembly of claim 15, wherein said front mailer sheet includes an outgoing envelope second fold line spaced apart from said first front mailer sheet outgoing envelope first fold line, said mailer defining an outgoing envelope having a height to length ratio of between approximately 1:1.3 to 1:2.5 when said mailer is folded upon itself along said front mailer sheet outgoing envelope first and second fold lines.

18. The mailer assembly of claim 15, wherein said mailer, when folded upon itself along said front mailer sheet outgoing envelope first fold line, defines an outgoing envelope having a height to length ratio of between approximately 1:1.3 to 1:2.5.

19. The mailer assembly of claim 15, wherein said back mailer sheet return envelope portion includes a return envelope fold line, said return envelope portion forming a return envelope having a return envelope pocket when folded along said return envelope fold line, said return envelope having a height to length ratio of between approximately 1:1.3 to 1:2.5.

20. The mailer assembly of claim 16, wherein said return envelope has a height to length ratio of between approximately 1:1.3 to 1:2.5.

21. The mailer assembly of claim 15, further including an additional mailer flysheet overlying and detachably engaging said front mailer sheet.

22. The mailer assembly of claim 15, wherein said series of interconnected individual mailers are held in alignment by control strip means disposed along marginal edges of said mailers, said series of interconnected mailers further including transverse lines of weakening separating individual mailers.

23. The mailer assembly of claim 15, wherein said front mailer sheet outgoing envelope face portion includes a designated address area thereon in a preselected location, said designated address area preselected location being chosen within the area of said front mailer sheet outgoing envelope face portion specified for optical character reading, when said mailer is folded upon itself along said outgoing envelope first fold line.

24. The mailer assembly of claim 15, wherein said front mailer sheet includes image transfer means for transferring an image printed on said front mailer sheet to said insert message sheet.

25. The mailer assembly of claim 24, wherein said individual mailer includes an additional insert message sheet, said insert message sheet including image transfer means thereon for transferring the image printed on said front mailer sheet to said additional insert message sheet.

26. A self contained insert mailer comprising at least two generally rectangular front and back plies adjacently overlying each other, the front ply of said two plies forming an outgoing envelope for said mailer when said mailer is folded along a first fold line, said front ply having an outgoing envelope face portion and an outgoing envelope back portion separated by the first fold line, the rear face of said back ply including adhesive means for adhesively securing said outgoing envelope together when said outgoing envelope is formed, said mailer including a return envelop ply disposed adjacent to said back ply, the back ply including a return envelope portion and a discard portion separated from the return envelope portion by a line of weakening, said return envelope ply having a return envelope fold line disposed generally parallel to said mailer first fold line, the return envelope fold line dividing said return envelope ply into distinct return envelope face and flap portions, said return envelope ply forming a return envelope of said mailer when said return envelope portion is folded along said return envelope fold line, said outgoing envelope having a predetermined height to length ratio conforming to postal height to length ratio standards.

27. The mailer of claim 26, wherein the predetermined height to length ratio of said mailer outgoing envelope is between approximately 1:1.3 to approximately 1:2.5.

28. the mailer of claim 26, further including a second return envelope ply disposed adjacently underneath said mailer back ply, said second return envelope ply having distinct discard and return envelope portions separated by a line of weakening, said second return envelope ply being adhesively secured to said return envelope ply to define a return envelope having a return envelope pocket therebetween.

29. The mailer of claim 26, wherein said front ply further includes a second fold line spaced apart from said first fold line, said second fold line separating an outgoing envelope intermediate portion from said outgoing envelope face and back portions said back ply adhesive means engaging said outgoing envelope intermediate portion when said mailer is folded upon itself along said first and second fold lines.

30. The mailer of claim 26, wherein said front and back plies are held in adjacently overlying relationship by detachment means including control strip means extending along opposite marginal edges of said plies.

31. The mailer of claim 26, wherein said front ply includes image transfer means for transferring the image printed on said front ply to said back ply.

32. The mailer of claim 26, wherein said front ply includes a designated address area is a preselected location on said front ply outgoing envelope face portion, said designated address area preselected location conforming to postal specifications for optical character reading of mailer addresses.

33. A self-contained insert mailer for mailing an insert, comprising a plurality of individual plies adjacently disposed in overlying relationship, each of said individual plies being of substantially equal size, the mailer including a front ply, a back ply and at least one insert ply disposed therebetween, said front ply including at least one fold line, said front ply defining a mailer outgoing envelope when said mailer is folded upon itself along said front ply fold line, said back ply including adhesive means disposed along a face thereof for adhesively securing said mailer after folding said mailer along said front ply fold line to form the mailer outgoing envelope, said back ply including a return envelope portion for forming a return envelope, said mailer outgoing envelope having a predetermined height to length ratio conforming to postal height to length ratio standards, said insert mailer further including a second back ply disposed adjacent said back ply, and said back ply and said second back ply having return envelope portions thereon, said return envelope portions being adhesively secured together to define a return envelope having a return envelope pocket therein, said back ply and said second back ply each including a discard portion, said back ply and said second back ply including lines of weakening separating said return envelope portions from the discard portions.

34. A self-contained insert mailer for mailing an insert, comprising a plurality of individual plies adjacently disposed in overlying relationship, each of said individual plies being of substantially equal size, the mailer including a front ply, a back ply and at least one insert ply disposed therebetween, said front ply including at least one fold line, said front ply defining a mailer outgoing envelope when said mailer is folded upon itself along said front ply fold line, said back ply including adhesive means disposed along a face thereof for adhesively securing said mailer after folding said mailer along said front ply fold line to form the mailer outgoing envelope, said back ply including a return envelope portion for forming a return envelope, said mailer outgoing envelope having a predetermined height and length ratio conforming to postal height to length ratio standards, said back ply further including a discard portion separated from said return envelope portion by a line of weakening, said return envelope portion having a back ply fold line separating said return envelope portion into a return envelope face portion and a return envelope flap portion, said back ply further including adhesive means disposed thereon which define a return envelope pocket when said return envelope face portion and flap portion are folded along said back ply fold line.

* * * * *